US005893854A

United States Patent [19]

Bontoux et al.

[11] Patent Number: 5,893,854

[45] Date of Patent: Apr. 13, 1999

[54] PAINLESS MECHANICAL HAIR-REMOVING DEVICE AND ITS RELATED METHOD

[75] Inventors: Daniel Bontoux, Saint-Genis-Laval; Monique Paget; Jean-Pierre Debourg, both of Lyons, all of France

[73] Assignee: SEB S. A., Ecully, France

[21] Appl. No.: 08/811,928

[22] Filed: Mar. 5, 1997

[30] Foreign Application Priority Data

Mar. 13, 1996 [FR] France ..... 96 03177

[51] Int. Cl.[6] ..... A61B 17/50

[52] U.S. Cl. ..... 606/133; 606/131

[58] Field of Search ..... 606/131, 133; 452/83, 100, 101

[56] References Cited

U.S. PATENT DOCUMENTS 5,261,919 11/1993 Niedertscheider ..... 606/133

FOREIGN PATENT DOCUMENTS

| | | | |
|---|---|---|---|
| 0 386 327 | 9/1990 | European Pat. Off. . | |
| 467733 | 1/1992 | European Pat. Off. | 606/133 |
| 0 493 849 | 7/1992 | European Pat. Off. . | |
| 0 671 136 | 9/1995 | European Pat. Off. . | |

*Primary Examiner*—Glenn K. Dawson

*Attorney, Agent, or Firm*—Young & Thompson

[57] ABSTRACT

A mechanical hair-removing device includes at least a vibrating part, drivers for providing a periodic alternative movement of the vibrating part and of a roller on which are located the hair-removing devices. The drivers of the hair-removing devices and the vibrating part are actuated simultaneously during a hair-removing session to cause a vibration of the hairy surface.

17 Claims, 4 Drawing Sheets

PAINLESS MECHANICAL HAIR-REMOVING DEVICE AND ITS RELATED METHOD

FIELD OF THE INVENTION

This invention relates to a mechanical hair-removing device and to a corresponding hair-removing method.

Mechanical hair-removing devices comprising nippers arranged on a roller are already known.

Those devices allow such a kinematic that when the roller rotates, the nippers close in the vicinity of the skin from which the hairs should be removed, whereby the hairs are pinched, picked-up and then torn off by the rotation of the roller before release of the nippers. Other well-known mechanical devices consist of springs whose turns are brought together, or of disks whose edges are close to one another, in the vicinity of the skin, whereas those devices have the same effect as the previous ones. We are also aware of systems with nippers subjected to an essentially vertical motion.

All those devices pinch and pull the hairs at random, that is to say not always in the vicinity of the root. Thus, a hair may well be exposed to several pulls before it is finally torn off. These successive pulls as well as the final tearing of the hairs irritate the nervous terminations close to the hair bulbs and cause the pain experienced when removing the hairs.

The document DE-44.08.809 C1 suggests a hair-removing apparatus provided with an electric device which generates currents in the skin, in order to reduce the pain experienced by a lady user. But such a device may be subject to contraindications, such as the presence of a pace-maker, and its efficiency is limited.

The European patent EP-348.862 discloses an auxiliary device for cooling of the skin before removing the hairs, designed for reducing the pain. This device, however, calls for an important cooling power in order to be efficient and the economy of this system leads to using the evaporation of water or of a lotion for cooling, which is somehow cumbersome.

The document EP-A-0 493 849 discloses a hair-removing method according to which the hairs are picked-up and drawn out of the skin by a hair-removing element. Just before the hair-removing a vibrating element engages the skin whose hairs are to be removed with application of variable intensity strengths on the skin such as the nervous terminations of the skin are affected.

BACKGROUND OF THE INVENTION

An object of this invention is a hair-removing device reducing, or even suppressing the pain experienced when removing the hairs, without the shortcomings mentioned above.

An object of the invention is also such a hair-removing device, with a compact shape.

The invention also relates to such a hair-removing device of simple execution and not requiring any other source of energy than that used to drive the hair-removing roller.

An another object of this invention is also a hair-removing method enabling to reduce the pain.

SUMMARY OF THE INVENTION

To this end, the object of the invention is a mechanical hair-removing device comprising:

a casing, at least one hair-removing means for a hairy surface, driving means for the hair-removing means, at least one vibrating part, means for driving the vibrating parts, to cause a periodic reciprocal movement of the said parts, whereas the driving means of the hair-removing means and of the vibrating parts are actuated simultaneously during the hair-removing session to vibrate the hairy surface.

According to the invention, the hair-removing device according to the invention comprises a roller with an axis, whereas this roller is carried by the casing and designed to be applied on the hairy surface. The hair-removing means are arranged on the roller and the driving means of the hair-removing means drive the roller into rotation.

Thus, while the nerve endings affected by the tearing away of the hairs are being irritated, they are also soothingly vibrated. Thus, by superimposing a painful stimulus with a continuous and well adjusted vibratory-type stimulus, the nervous influx is overcome by the vibrations and the pain is not felt any longer.

Preferably, the driving means of the vibrating parts are coupled with the driving means of the hair-removing means and actuated into operation by those driving means of the hair-removing means.

This configuration not only saves energy, but also makes a compact shape of the hair-removing device possible.

In a first preferred embodiment of the hair-removing device according to the invention, the vibrating parts are designed for undergoing a translational movement substantially perpendicular to the hairy surface.

Advantageously, the driving means of the vibrating parts comprise:

a first shaft arranged in a fixed position in the casing and designed to be driven into rotation, a second shaft arranged in the casing substantially aligned with the first shaft and supported by the vibrating parts, an elastic seal connecting both shafts, elastic means connecting flexibly the vibrating parts to the casing, and a balance weight eccentrically connected rigidly to the second shaft, such that the rotation of the first shaft causes a translational movement of the vibrating parts substantially perpendicular to the hairy surface.

In this case, the hair-removing device comprising a roller on which have been arranged the hair-removing means, the first shaft and the roller are advantageously driven into rotation by the same motor using a gearing system.

In a second preferred embodiment of the device according to the invention, the vibrating parts are designed for undergoing a rotational movement.

Advantageously, the hair-removing device comprising a roller carried by the casing and on which have been arranged the hair-removing means, the vibrating parts are then arranged on the roller.

In a first preferred mode of this second embodiment, the roller is provided with at least one notch designed for accommodating the vibrating parts, whereby these parts are able to slide radially in the notches and the hair-removing device comprises means for retaining the vibrating parts, thus enabling those parts to come partially out of the notches while remaining connected to the roller. Thus, when the roller rotates, the vibrating parts are centrifuged to the outside.

According to a second preferred mode of the second embodiment, the roller having an axis, the vibrating parts each comprise an articulation edge and a free edge. The articulation edge is linked to the roller and accomodates an axis articulation substantially parallel to the axis of the roller, and the driving means of the roller are such that the articulation edges are ahead of rotational movements. Thus, during the rotation of the roller, the free edges of the vibrating parts are centrifuged to the outside.

Preferably, the driving means of the vibrating parts generate during operation a vibratory solicitation on the hairy surface at a vibration frequency of approximately 100 Hz.

The attenuation of the pain is most efficient with a vibration at this 100 Hz frequency. Moreover, it is advised not to exceed a maximum of 300 Hz, since the nervous response is not proportional to the vibration frequency above that frequency.

The object of the invention is also a mechanical hair-removing method for a hairy surface.

This method is characterised in that the hairy surface undergoes a vibratory mechanical stimulus in order to reduce the pain caused by the hair-removing operations.

DETAILED DESCRIPTION OF THE PREFERRED EMBODIMENT

Figure 1:
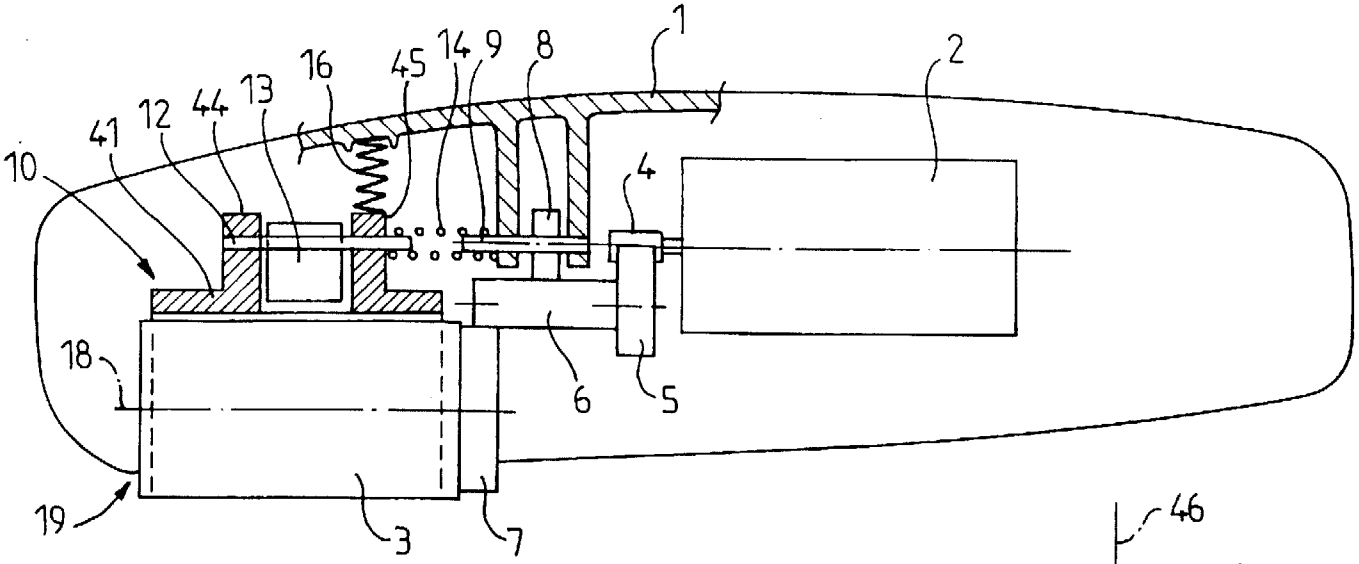
FIG. 1 is a diagrammatical representation of a longitudinal section of a first embodiment of a hair-removing device according to the invention.
Figure 2:
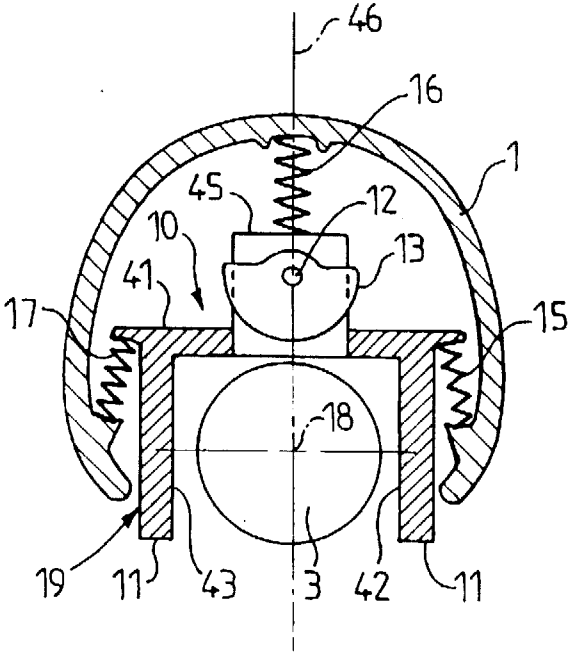
FIG. 2 shows a cross section of the embodiment represented on FIG. 1.

In a first embodiment of a hair-removing device according to the invention, represented on FIGS. 1 and 2, this device comprises a casing 1 of oblong hand-held shape. The casing 1 carries a roller 3 having an axis 18, whereas this roller 3 is provided with nippers and with a mechanism for opening and closing the nippers. The roller 3 projects from the casing by an opening 19 and is designed for application on a hairy surface at the level of this opening 19.

The hair-removing device also comprises a motor 2 housed in the casing 1, capable of actuating the roller 3 into rotation around its axis 18, as well as its mechanism for opening and closing the nippers. The transmission of the movements of the motor 2 to the roller 3 is performed by a gear train made of wheels such as 4, 5, 6, 7 reducing the speed.

According to the invention, the hair-removing device also comprises a vibrating part 10. This vibrating part has a substantially cylindrical shape, with a straight U-shaped section and a generating line parallel to the axis 18 of the roller 3. It comprises a base 41 limited by two lateral right-angled legs 42 and 43, whereby both these legs 42 and 43 comprise ends 11. The vibrating part 10 surrounds partially the roller 3, whereas the ends 11 are oriented towards the opening 19 and the legs 42 and 43 are substantially centered longitudinally on the roller 3. The ends 11 are designed for projecting from the opening 19 to press the vibrating part 10 onto the hairy skin, in the vicinity of the hair-removing roller 3. The vibrating part 10 is designed for undergoing substantially translational movements, perpendicular to the hairy surface, that is to say substantially parallel to the legs 42 and 43, thanks to means for driving this vibrating part 10.

Moreover, the vibrating part 10 comprises articulation lugs 44 and 45 extending from the base 41 in a direction opposite the legs 42 and 43, whereby the lugs 44 and 45 are substantially rectangular plates, oriented at right angle with respect to the legs 42 and 43.

The driving means of the vibrating part 10 comprise particularly a wheel 8 meshing with the wheel 6, as well as a first shaft 9 connected rigidly to the wheel 8 and arranged according to its axis. The driving means of the vibrating part 10 also comprise a second shaft 12 supported by the vibrating part 10. This shaft 12 is substantially aligned, on an average, on the shaft 9. A flexible mechanical seal 14 connects the shafts 9 and 12, ensuring their rotational linkage while allowing for misalignments.

The axis 18 and the shaft 12 define a direction 46 of vibration, whereas this direction 46 cuts across the shaft 12 and the axis 18 in a cross section of the casing 1 (FIG. 2).

The second shaft 12 is connected rigidly to an eccentric balance weight 13. In the example represented, the balance weight 13 has substantially the shape of a semi-disk, with the center substantially at the level of the second shaft 12.

The second shaft 12 goes through the articulation lugs 44 and 45 of the vibrating part 10, which supports it while leaving it free to rotate.

The balance weight 13 is placed between the articulation lugs 44 and 45 and substantially centered above the base 41.

The vibrating part 10 is hung in the casing 1 by flexible elastic links 15, 16, 17. For instance, the springs 15 and 17 link laterally to the casing 1 the linking elbows between the base 41 and, respectively, the legs 42 and 43, and springs 16 link the casing to articulation lugs 44 and 45.

During operation, the motor 2 drives the roller 3 as well as its pinching mechanism into rotation. The wheel 8 is brought into motion and drives the balance weight 13 into rotation, which causes vibratory movements of the vibrating part 10, substantially translational in the direction 46.

When the roller 3 is applied on the skin and tears the hairs away, it causes a painful feeling, but the nerve endings already receive the sensation of the vibrations induced by the ends 11 of the vibrating part 10 and are saturated. The pain is therefore suppressed or significantly reduced.

Preferably, the roller 3 is brought into rotation at a speed in the order of 1200 rpm and the first shaft 9 has a speed in the order of 6000 rpm. The vibrating part 10 is thus subjected to a vibration of about 100 Hz for which the attenuation of the pain is most efficient.

As an alternative of this first embodiment, the vibrating part 10 may comprise a plurality of projections on either side of the base 41, instead of a single massive leg 42, 43.

Moreover, the means for driving the roller 3 and the vibrating part 10 can be separated and particularly comprise separate motors. The configuration represented is however suitable for an energy saving and the compactness of the hair-removing device.

Figure 4:
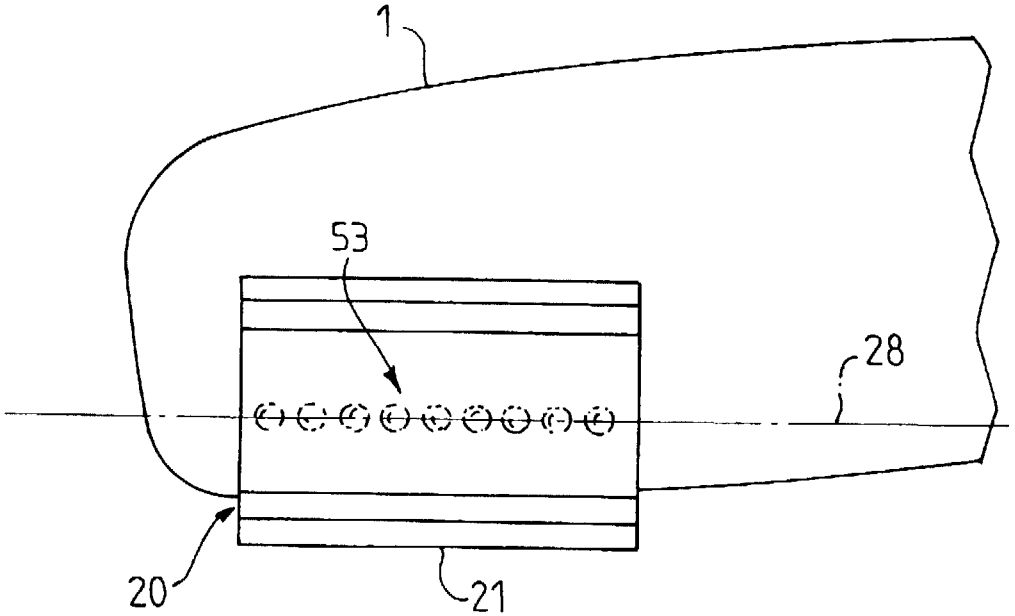
FIG. 4 represents a longitudinal view of the roller of FIG. 3.
Figure 3:
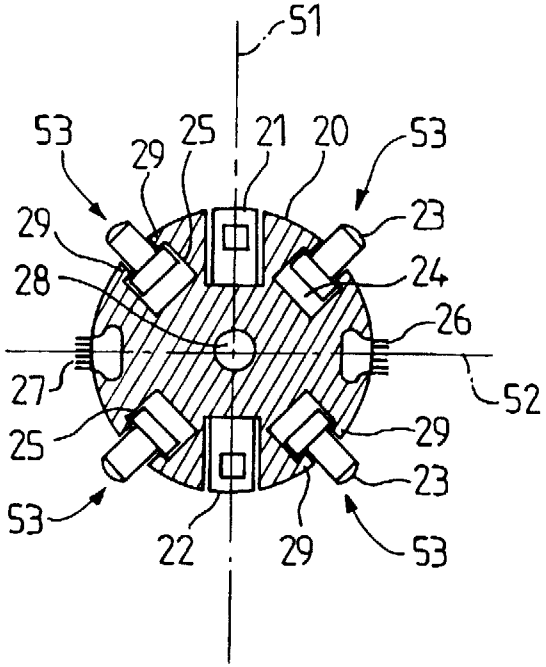
FIG. 3 shows a cross section of the roller present in a second embodiment of the hair-removing device according to the invention.

In a second embodiment of the hair-removing device according to the invention, represented on FIGS. 3 and 4, the hair-removing device comprises a roller 20 in which has been integrated a system for attenuating the pain.

The roller 20 is substantially cylindrical with a circular section and an axis 28. The roller 20 carries two rows 21 and 22 of nippers capable of being moved into operation, arranged according to a first diameter 51 of the cylindrical section of the roller 20. Two rows 26, 27 of small brushes designed for sweeping the hairs once torn away, have been arranged according to a second diameter 52 perpendicular to the first diameter 51.

Grooves 24, four in number, have been drilled in the cylinder 20 parallel to the axis 28 and at 45° angle of the diameters 51 and 52. The grooves 24 are shrunk at the periphery of the roller 20 using blocking ends 29.

The hair-removing device comprises vibrating parts 53 each containing a balance weight 23 and a heel 25. The heels 25 of the vibrating parts 51 are arranged to slide radially in the grooves 24. They are retained using the blocking ends 29. In the embodiment shown, the vibrating parts 53 extend several in number along the axis 28 (FIG. 4).

During operation, the roller 20 rotates and the balance weights 23 are centrifuged towards the outside of the roller 20 from whose periphery they project by several millimeters. When applying the roller 20 onto the skin, the balance weights 23 will hit the latter, causing a vibratory feeling whose frequency is proportional to the rotational speed and to the number of vibrating parts 53 distributed over the periphery. The nervous terminations are thus saturated. After each shock against the skin, the balance weights 23 retract into their grooves 24, which enables the roller 20 and the nippers 21, 22 to remain in contact with the skin and to remove the hairs as closely as possible.

Preferably, the roller is designed for rotating at 1,500 rpm, which corresponds to a rotational frequency of 25 Hz.

The hair-removing frequency, defined as the product of the rotational frequency by the number of rows of nippers distributed on the periphery of the roller 20, is then of 50 Hz.

Since four vibrating parts 53 are distributed on the periphery of the roller 20, the skin is thus excited at 100 Hz, which produces pain killing or attenuating effects.

In an alternative of this second embodiment, the vibrating parts 53 extend as one single part along the axis 28.

The number of balance weights 23 distributed on the periphery of the roller 20 may be greater or smaller than four in quantity, the main thing is to be able to apply a vibratory solicitation at the desired frequency. The example given constitutes however a good compromise between the hair-removing and the vibrating frequencies.

Figure 5:
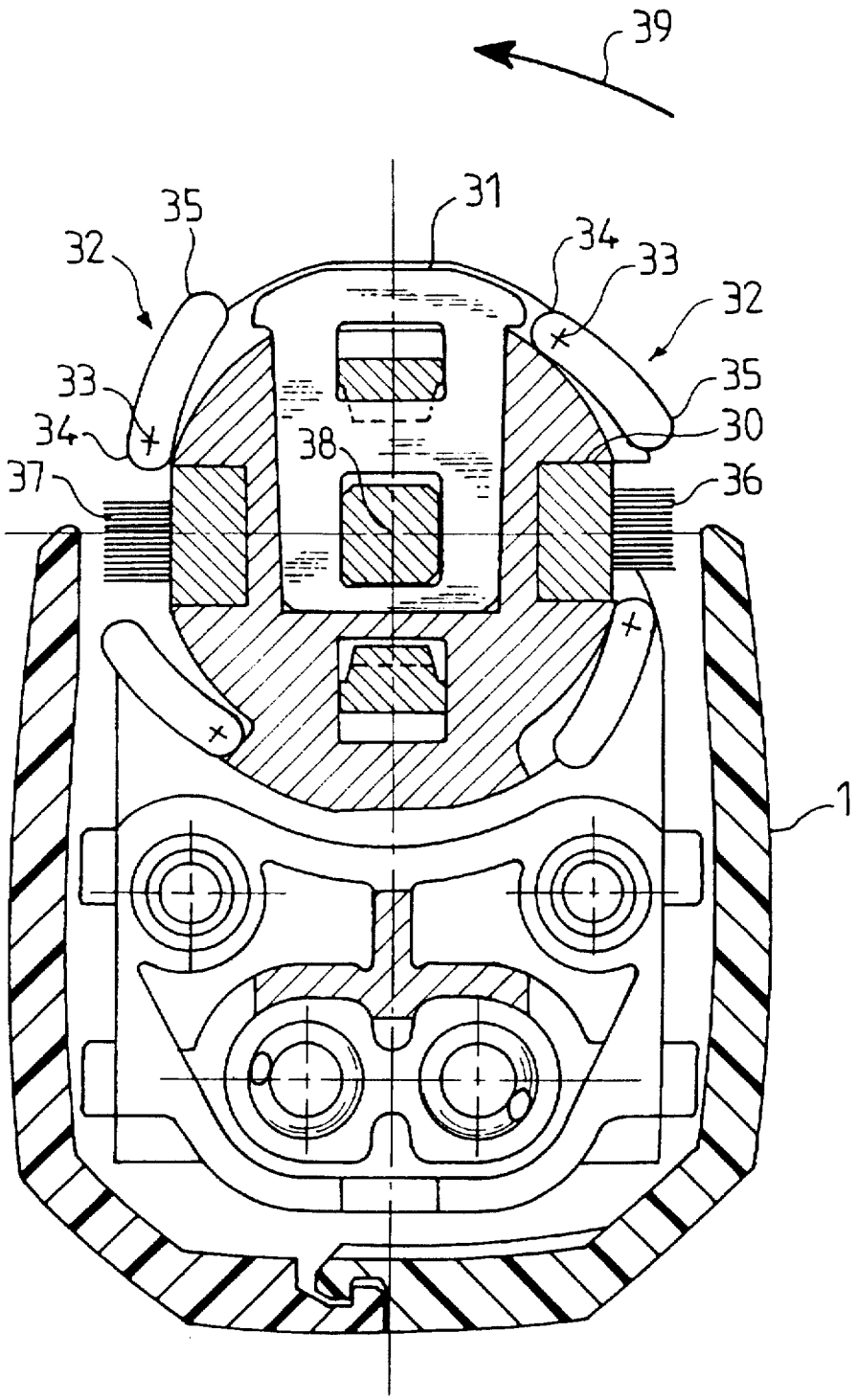
FIG. 5 represents a cross section of a third embodiment of the hair-removing device according to the invention.

In a third embodiment of the hair-removing device according to the invention, represented on FIG. 5, the former comprises, as in the second embodiment, a roller 30 carrying several vibrating parts 32. The roller 30, of substantially circular section and axis 38, is provided with a row 31 of nippers capable of being moved during a hair-removing operation, parallel to the axis 38. It also comprises two rows 36, 37 of small brushes parallel to the axis 38, arranged on a plane perpendicular to the row 31 of nippers.

The vibrating parts 32 have each a cylindrical shape admitting a generating line parallel to the axis 38 and a section of oblong shape. They each comprise an articulation edge 34 and a free edge 35 at ends of this oblong shape. The articulation edge 34 of each of the vibrating parts 32 is connected to the periphery of the roller 30 according to an articulation axis 33, whereas the vibrating part 32 can partially rotate around this axis 33. The articulation edges 34 are arranged in order to be ahead of rotation movements, whereas the latter are arranged in one direction 39.

In the example shown, the vibrating parts are four in number, distributed evenly on the periphery of the roller 30 and substantially at 45° angle of the rows 36 and 37 of small brushes.

During operation, whereas the roller 30 is rotating, the free edges 35 of the vibrating parts 32 are centrifuged and hit the skin in the vicinity of the hair-removing zone.

The frequency of the light shocks is the product of the rotational frequency by the number of vibrating parts 32 distributed on the periphery of the roller 30. Preferably, in the example shown, the roller 30 rotates at 1,500 rpm, which corresponds to a rotational frequency of 25 Hz. The skin is thus excited at 100 Hz, which produces the best pain-killing effects.

As an alternative, the number of vibrating parts 32 distributed on the periphery of the roller 30 can be greater or smaller than four, and each of the massive vibrating parts 32 can be replaced with a row of vibrating parts parallel to the axis 38.

The hair-removing device according to the invention can be provided with another mechanical hair-removing system than that illustrated in the previous embodiments, consisting of a roller provided with nippers. Thus, according to other embodiments of the hair-removing means, these comprise a spring, a set of nippers moving vertically or a pile of disks coming closer to the skin in order to pinch and to tear away the hairs.

Figure 7:
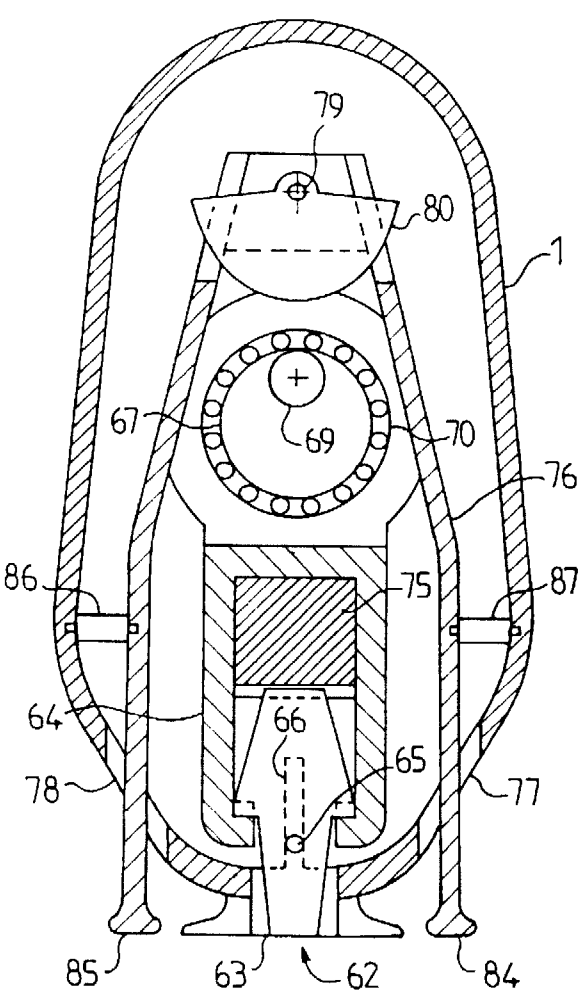
FIG. 7 represents a cross section of the hair-removing device of FIG. 6.
Figure 6:
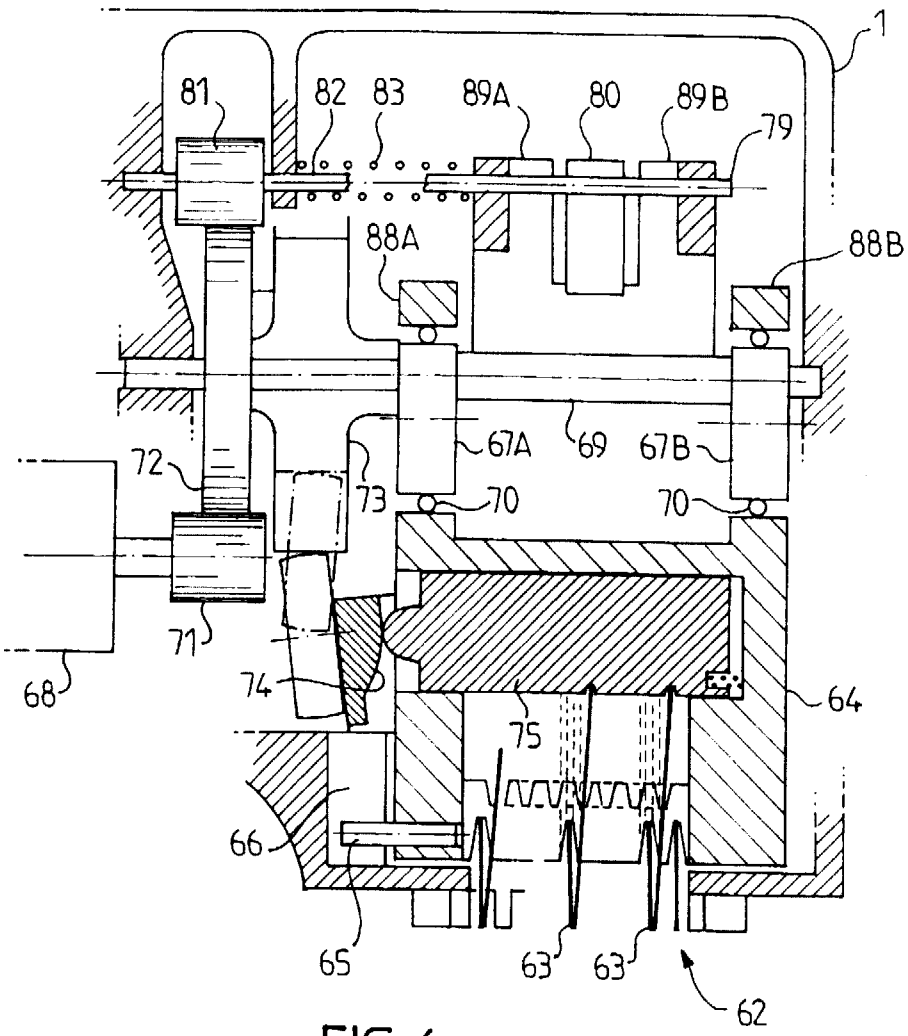
FIG. 6 shows a longitudinal section of a fourth embodiment of a hair-removing device according to the invention.

One of these other possibilities, consisting of a set of nippers with vertical motion, is illustrated by a fourth embodiment of the hair-removing device according to the invention, represented on FIGS. 6 and 7. The casing 1 of this hair-removing device is open towards a lower side 62, in order to expose the ends of blades 63 designed for pinching the hairs.

The blades 63 are carried by a driving part 64 or slide, which comprises a lateral lug 65 and two lateral dials 88A and 88B arranged in its upper part, and having substantially the shape of parallel vertical crowns. A vertical groove 66 drilled into the casing 1 accommodates the lug 65. The lug 65, designed for sliding inside the groove 66, thus enables a vertical translational movement of the slide 64 in the casing 1.

The hair-removing device is provided with means for driving the slide 64. The latter particularly comprise a motor 68, a first pinion 71 brought into rotation by the motor 68 and a toothed wheel 72 meshing with the first pinion 71. The toothed wheel 72 is centred on a first shaft 69 which it drives into rotation. The driving means of the slide 64 also comprise two eccentrics 67A and 67B mounted on the first shaft 69 and arranged respectively at openings drilled into both lateral dials 88A and 88B. Roller bearings 70 ensure the junction between the eccentrics 67A and 67B and respectively the dials 88A and 88B. The eccentrics 67A and 67B, driven into rotation by the motor 68 via the first pinion 71, the toothed wheel 72 and the first shaft 69, can then produce an oscillating vertical movement of the slide 64.

The hair-removing device also comprises a mechanism for actuating the blades 63. This actuating mechanism comprises particularly a first cam 73 linked to the toothed wheel 72, a second cam 74 associated with the first cam 73 and a rack 75 on which acts the second cam 74. The rack 75, arranged in the slide 64, is linked to the blades 63 and enables the opening and closing of nippers formed by the blades 63.

The hair-removing device comprises moreover a horseshoe-shaped vibrating part 76, extending through the casing 1 by lower openings 77 and 78. The ends 84 and 85 of the vibrating part 76, projecting respectively from the casing 1 by the openings 77 and 78, form projections that can be applied on the hairy surface, on either side of the hair-removing zone opposite the blades 63. The ends 84 and 85 are each made of a single block. In an alternative of embodiment, they comprise several teeth.

Means for driving the vibrating part 76 comprise, apart from the motor 68, the first pinion 71 and the toothed wheel 72, a second pinion 81 meshing with the toothed wheel 72 and connected rigidly to a second shaft 82 arranged according to its axis. The second shaft 82 is linked to a third shaft 79 by a flexible transmission seal 83 allowing for misalignments between the second pinion 81 and the third shaft 79. The seal 83 is for instance a spring. The third shaft 79 is carried by the vibrating part 72. It is connected rigidly to an eccentric balance weight 80, having substantially the shape of a semi-disk, which it drives into rotation. The vibrating part 76 comprises two upper arms 89A and 89B, through which extends the third shaft 79 and between which the balance weight 80 has been arranged. The vibrating part 76 is linked to the casing 1 by two lateral retaining parts 86 and 87, made of low hardness elastomer. Those retaining parts 86 and 87 contribute, with the seal 83, to maintain the average position of the vibrating part 76.

During operation, the lower open section of the casing 1 is applied on the hairy surface. The nippers formed by the blades 63 pinch the hairs and tear them upwards. Simultaneously and continuously, the rotation of the balance weight 80 at a rotational frequency causes a vertical movement of the vibrating part 76 at equal vibration frequency. The ends 84 and 85, acting as vibrating projections thus apply a vibratory mechanical solicitation to the zone from which hairs are removed, which reduces the pain considerably.

Advantageously, the motor rotates at about 6,000 rpm as well as the balance weight 80, which corresponds to a vibration frequency of 100 Hz. The slide 64, for its own part, is actuated at a frequency four times lower.

We claim:

1. A hair-removing device, comprising:

a roller with hair-removing means thereon for removing hair from a hairy surface;

at least one vibrating part for vibrating the hairy surface adjacent said roller;

a motor for operating the device;

a casing rotatably carrying said roller;

elastic links carrying said vibrating part within said casing;

a first shaft rotated by said motor and rotatably carried by said casing;

a second shaft rotatably carried by said vibrating part;

a flexible member connecting said first and second shafts; and a weight eccentrically affixed to said second shaft that causes said vibrating part to vibrate substantially perpendicular to a longitudinal axis of said second shaft when said motor is operating.

2. The device of claim 1, wherein said first shaft is connected to said roller to rotate said roller.

3. The device of claim 2, further comprising transmission gears connecting said roller to said first shaft to change a rotational speed of said roller from that of said motor.

4. The device of claim 1, wherein said vibrating part vibrates at about 100 Hz when said motor is operating.

5. The device of claim 1, wherein said vibrating part is U-shaped and said roller is between legs of said U-shaped vibrating part.

6. The device of claim 5, wherein said second shaft is rotatably carried at an apex of said U-shaped vibrating part.

7. A hair-removing device, comprising:

a casing;

a roller rotatably carried within said casing;

a motor connected to said roller;

hair-removing means for removing hair from a hairy surface, said hair-removing means being carried by said roller; and plural vibrating parts carried by said roller that are arranged and constructed to vibrate the hairy surface when said roller is rotating, wherein said roller comprises notches in an exterior surface that slidably hold said vibrating parts so that said parts extend radially outward due to centrifugal force when said roller is rotating.

8. The device of claim 7, wherein said vibrating parts are generally cylindrical with an annular extension and said notches comprise a shoulder that engages said annular extension to prevent escape of said vibrating parts.

9. The device of claim 7, wherein said vibrating parts are in rows on an exterior surface of said roller.

10. The device of claim 7, wherein said vibrating parts and said hair-removing means are in separate rows parallel to an axis of rotation of said roller on an exterior surface of said roller.

11. The device of claim 10, wherein one of said rows of hair-removing means is between two of said rows of vibrating parts.

12. A hair-removing device, comprising:

a casing;

a roller rotatable carried within said casing;

a motor connected to said roller;

hair-removing means for removing hair from a hairy surface, said hair-removing means being carried by said roller; and plural vibrating parts carried by said roller that are arranged and constructed to vibrate the hairy surface when said roller is rotating, wherein said vibrating parts are in rows on an exterior surface of said roller, wherein a number of said rows and a speed of rotation of said roller provide a vibration speed of said vibrating parts of about 100 Hz when said motor is operating.

13. The device of claim 12, comprising four of said rows.

14. A hair-removing device, comprising:

a casing;

a roller rotatable carried within said casing;

a motor connected to said roller;

hair-removing means for removing hair from a hairy surface, said hair-removing means being carried by said roller; and plural vibrating parts carried by said roller that are arranged and constructed to vibrate the hairy surface when said roller is rotating, wherein said vibrating parts each have one free end and another end hinged to said roller along an axis substantially parallel to an axis of rotation of said roller so that said free ends pivot radially outward due to centrifugal force when said roller is rotating.

15. The device of claim 14, wherein said roller comprises notches in an exterior surface that receive said vibrating parts so that said parts lie generally flush with the exterior surface.

16. The device of claim 14, wherein a speed of vibration of said vibrating parts is about 100 Hz when said motor is operating.

17. A hair-removing device, comprising:

a casing;

a roller rotatably carried within said casing;

a motor connected to said roller;

hair-removing means for removing hair from a hairy surface, said hair-removing means being carried by said roller; and plural vibrating parts that vibrate the hairy surface when said roller is rotating, each having a retained end carried by said roller and a free end that moves radially outward due to centrifugal force when said roller is rotating.

* * * * *